US005860813A

United States Patent [19]

Irlbeck et al.

[11] Patent Number: 5,860,813

[45] Date of Patent: Jan. 19, 1999

[54] ELASTOMERIC CONNECTOR WITH CONTROL OF LOOSE CIRCUITRY

[75] Inventors: Robert Daniel Irlbeck; Charles Thomas Long, both of Greensboro, N.C.

[73] Assignee: The Whitaker Corporation, Wilmington, Del.

[21] Appl. No.: 841,296

[22] Filed: Apr. 29, 1997

[51] Int. Cl.[6] ..... H01R 9/09

[52] U.S. Cl. ..... 439/67; 439/66

[58] Field of Search ..... 439/65, 66, 67, 439/86, 90, 91, 492, 493, 495, 496, 499

[56] References Cited

U.S. PATENT DOCUMENTS 3,960,424 6/1976 Weisenburger ..... 439/66
3,985,413 10/1976 Evans ..... 339/17
5,540,594 7/1996 Collins et al. ..... 439/66
5,588,846 12/1996 Irlbeck et al. ..... 439/66

*Primary Examiner*—Gary Paumen
*Assistant Examiner*—Yong Ki Kim
*Attorney, Agent, or Firm*—Robert Kapalka

[57] ABSTRACT

An elastomeric electrical connector (30) comprises an elastomeric core (32) having sides (48) extending in a longitudinal direction between opposite ends (46), and a flexible film (34) having circuit traces (36) thereon wrapped around the core. One of the sides (48) has a relief (50) and the flexible film has a crease (40) directed into the relief. The crease predisposes a portion of the flexible film to gather in the relief when the core is compressed in the longitudinal direction, thereby preventing circuit traces on loose flexible film from causing inadvertent electrical shorts.

7 Claims, 5 Drawing Sheets

ELASTOMERIC CONNECTOR WITH CONTROL OF LOOSE CIRCUITRY

FIELD OF THE INVENTION

The invention relates to an elastomeric electrical connector of the type having an elastomeric core which is wrapped in a flexible film having circuit traces thereon.

BACKGROUND OF THE INVENTION

Elastomeric electrical connectors of the type disclosed in U.S. Pat. No. 3,985,413 are sold by AMP Incorporated of Harrisburg, Pa. under the trademark AMPLIFLEX and are commercially available in many different geometries. One of these geometries is a relatively tall and thin connector 10 which is shown in FIGS. 1 and 2. The connector 10 includes an elastomeric core 12 and a flexible film 14 having circuit traces 16 thereon wrapped around the core. The connector 10 is housed between walls of a slot 2 in a dielectric housing 4 and is compressed between opposed substrates 5 and 6 on opposite sides of the housing. The substrates have respective sets of electrical contact pads 7*a,* 7*b,* 7*c* and 8*a,* 8*b,* 8*c*. The pads 7*b* and 8*b* are electrically interconnected by the circuit traces 16 on the connector 10.

In an uncompressed state, the connector 10 has curved surfaces at upper and lower ends 18, 19, and has a uniform width between the ends. As the connector is compressed in the vertical or elongation direction, natural tackiness of the core 12 keeps the flexible film 14 substantially adhered to the sides of the core and prevents the film from buckling. This compression causes the core to swell and causes the ends 18, 19 of the core to distort to a flat shape. This distortion causes the film to separate from the core. As a result, a portion of the film and circuitry may collect near an end of the connector, thereby leading to problems in the form of pinched circuitry and electrical shorting to adjacents rows of contact pads 7*a,* 7*c,* 8*a,* 8*c* on the substrate. In FIG. 1, the slot 2 has beveled edges 3 to provide space in which loose circuitry 22 can collect. This slot design alleviates pinching of the circuitry, but shorting to adjacent contact pads can still occur. In FIG. 2, the slot does not have beveled edges. This slot design hinders shorting but causes pinching of loose circuitry 24 which may lead to shorting as well. There is a need for an elastomeric electrical connector which overcomes these problems.

SUMMARY OF THE INVENTION

An elastomeric electrical connector comprises an elastomeric core having sides extending in a longitudinal direction between opposite ends, and a flexible film having circuit traces thereon wrapped around the core. One of the sides has a relief and the flexible film has a crease directed into the relief. The crease predisposes a portion of the flexible film to gather in the relief when the core is compressed in the longitudinal direction, thereby preventing circuit traces on loose flexible film from causing inadvertent electrical shorts.

BRIEF DESCRIPTION OF THE DRAWINGS

The invention will now be described by way of example with reference to the accompanying drawings wherein.

DETAILED DESCRIPTION OF AN EMBODIMENT OF THE INVENTION

Figure 1:
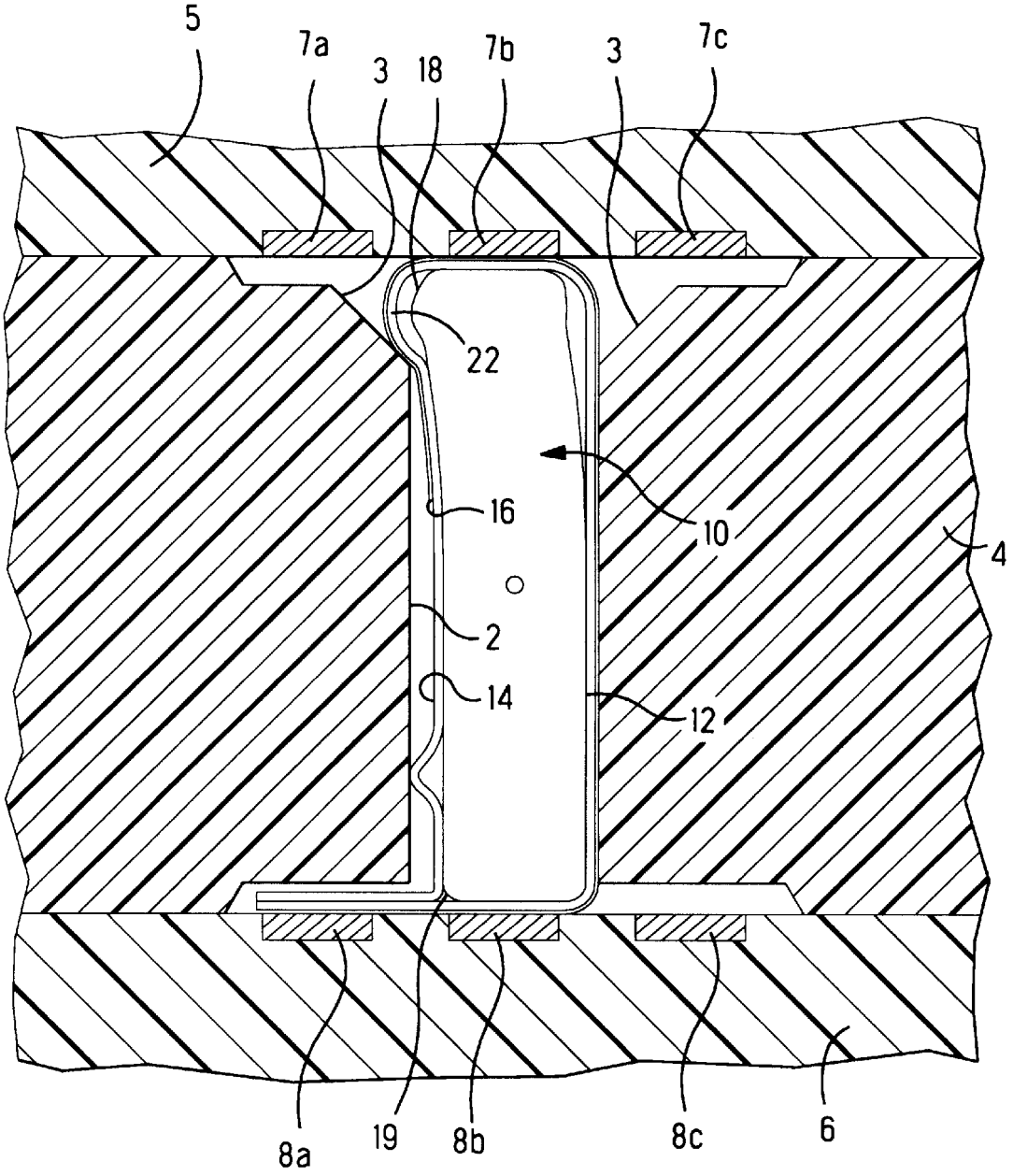
FIG. 1 Prior Art
FIG. 1 is a cross-sectional view of a prior art elastomeric connector being compressed within a slot in a housing.
Figure 2:
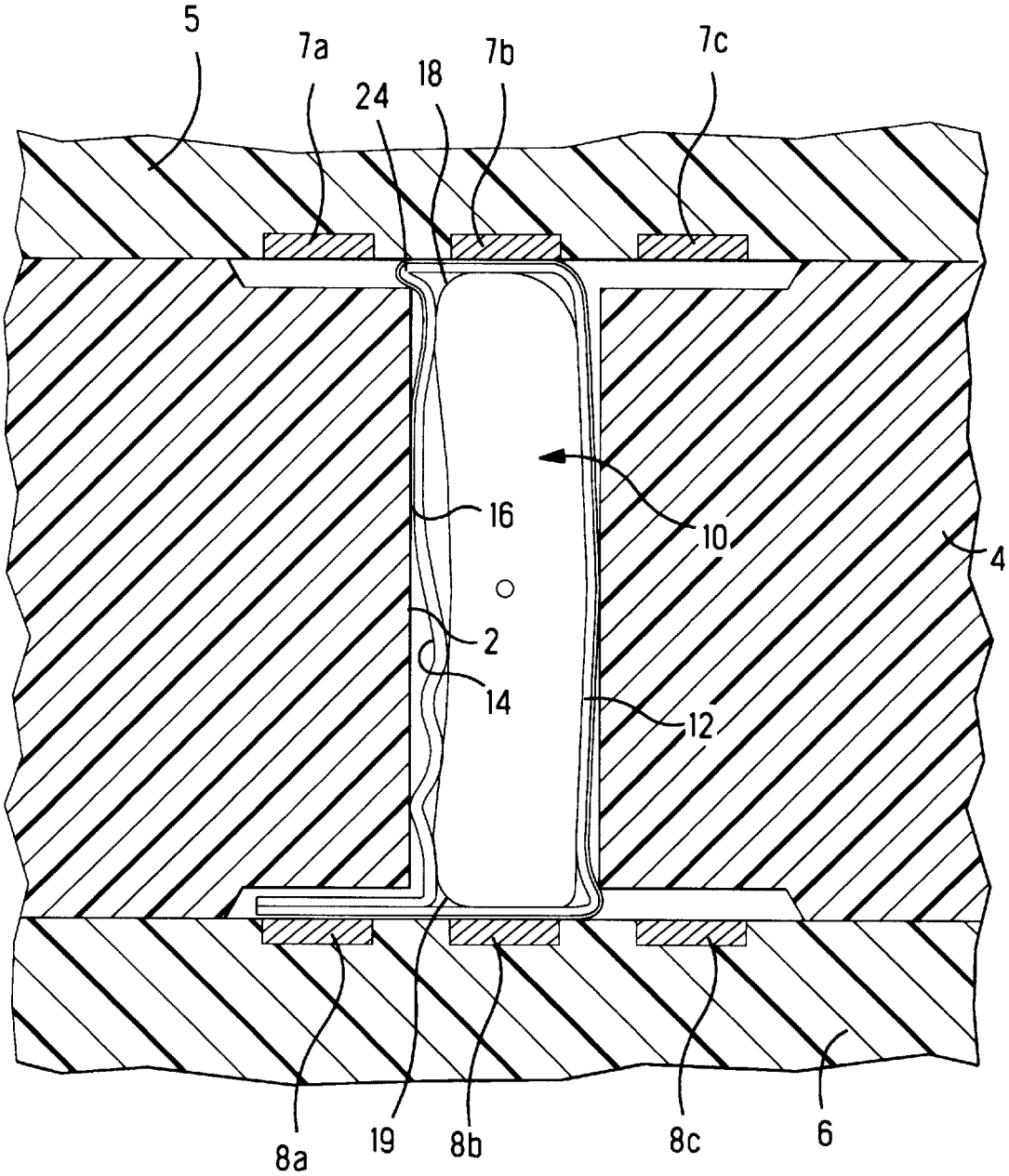
FIG. 2 Prior Art
FIG. 2 is a cross-sectional view of the prior art connector being compressed within a modified slot in a housing.
Figure 3:
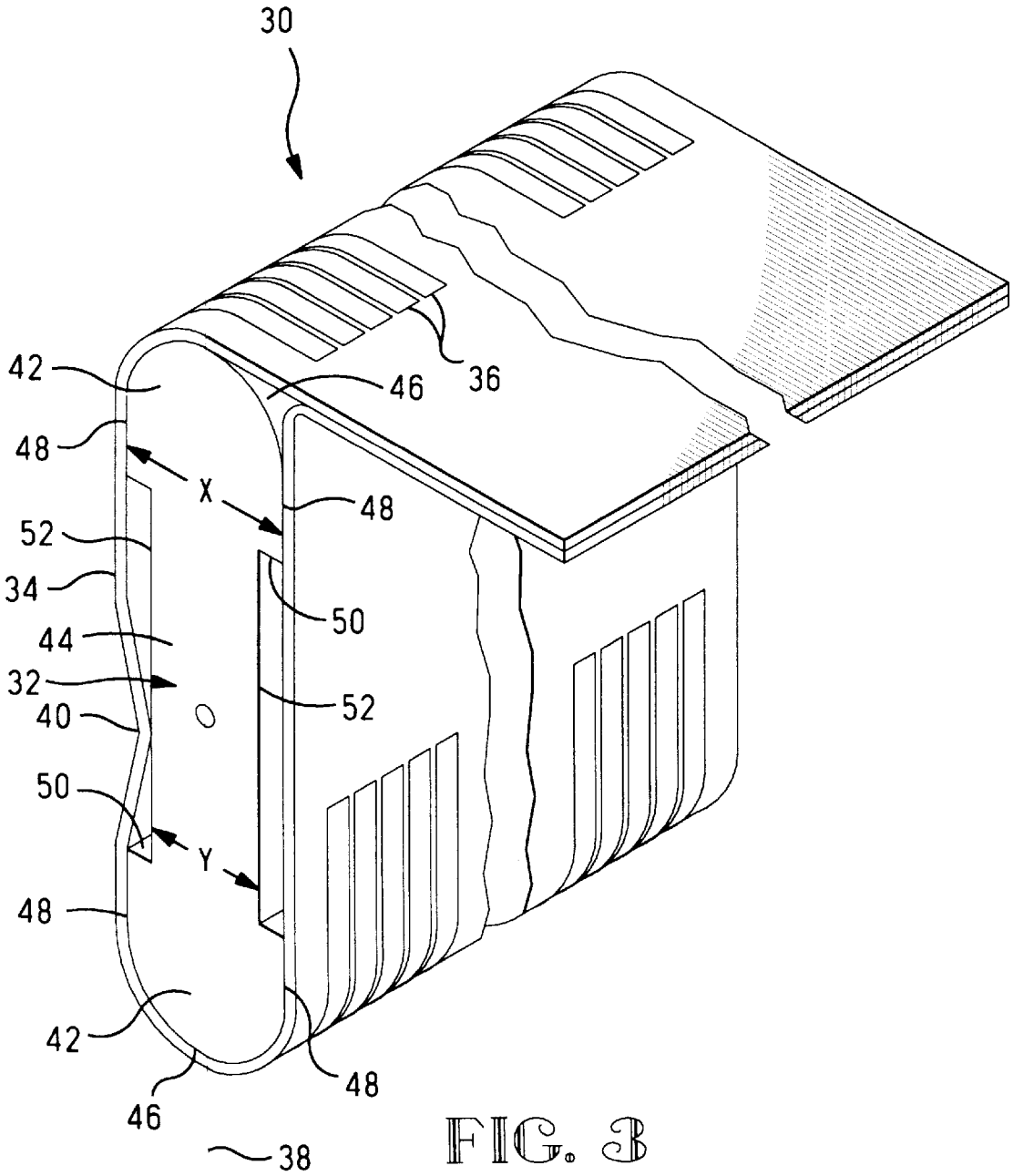
FIG. 3 is an isometric view of an elastomeric connnector according to the invention.

There is shown in FIG. 3 an electrical connector 30 according to the invention comprising an elastomeric core 32 and a flexible film 34 having circuit traces 36 thereon wrapped around the core. The circuit traces are aligned in side-by-side relationship along a length of the core. The core is longitudinally elongated along an axis 38 which coincides with a compression axis of the connector when the connector is operationally mounted in a housing. The core 32 has a dogbone shape with a pair of opposite end portions 42 connected by an intermediate portion 44. Each of the end portions 42 has a curved end surface 46 and straight side surfaces 48. Each of the end portions has a width X between the side surfaces 48. Preferably, each of the end portions 42 has the same width X. A core envelope is defined by the surfaces 46 and 48 of both end portions together with imaginary projections of the side surfaces 48 from one end portion to the side surfaces 48 of the other end portion. The intermediate portion 44 has a width Y which is less than the width X of the end portions. The intermediate portion 44 is defined by at least one relief 50 in a surface of the core between the end portions 42, whereby the intermediate portion has a surface 52 which is recessed below the core envelope. Preferably, the core has two reliefs 50 on opposite sides of the compression axis 38 so that the core is symmetric about the compression axis.

Figure 4:
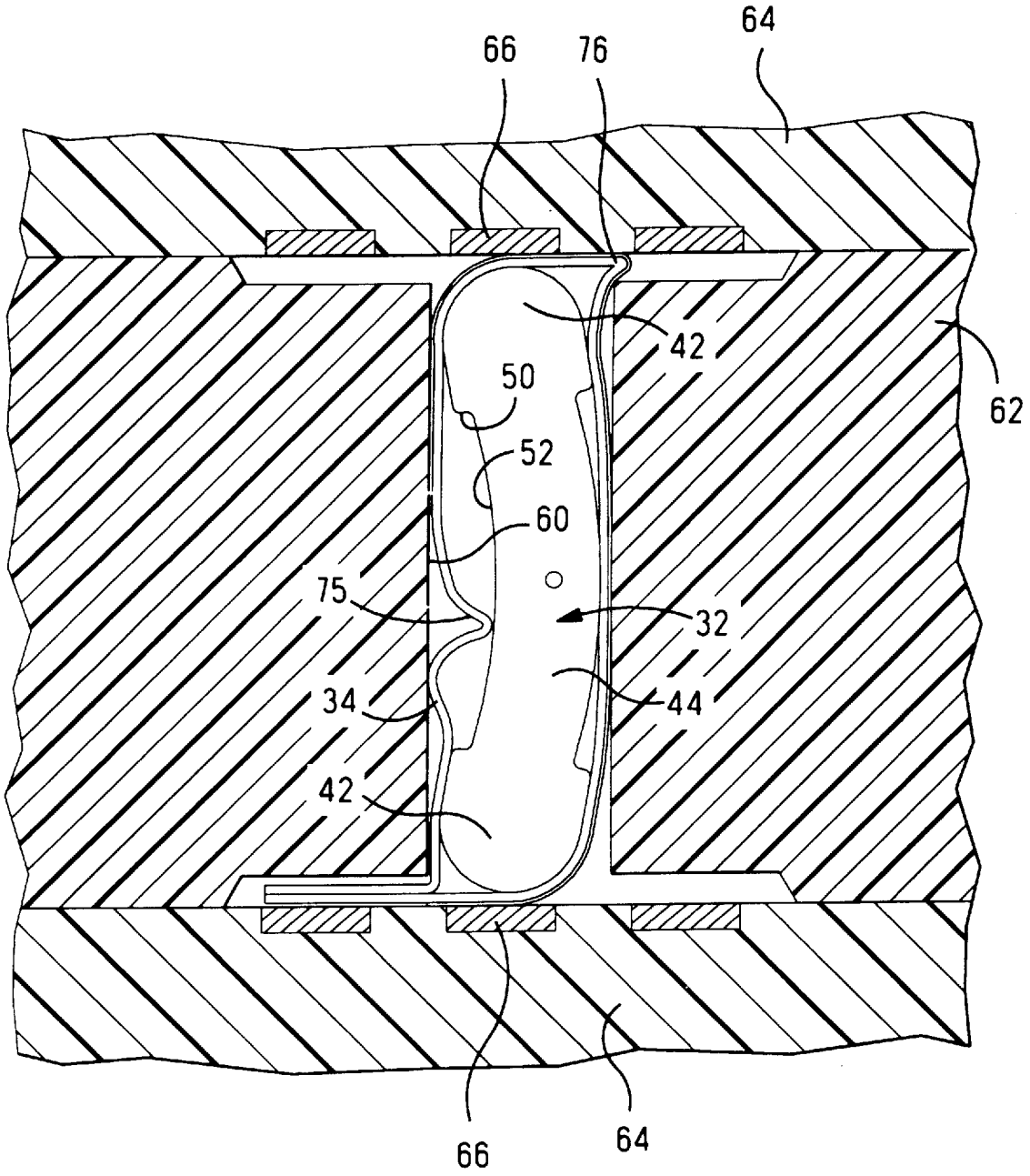
FIG. 4 is a cross-sectional view of a connector having reliefs according to the invention and being compressed in a slot in a housing.

FIG. 4 depicts the connector 30 as above-described and operationally mounted in a slot 60 in a dielectric housing 62. The connector is being compressed between substrates 64 each having contact pads 66. The flexible film 34 is encouraged to adhere around the end portions 42 of the core, but the reliefs 50 prevent the film from adhering along the sides. The intermediate section 44, being thinner than the end portions 42, tends to buckle and swell, and localized distortion of the end portions is reduced compared to the prior art design. As shown in FIG. 3, the circuit traces 36 on the film do not completely encircle the core 32. The portion of the film without the circuit traces lacks columnar strength which the circuit traces provide. Consequently, the portion of the film without the circuit traces tends to buckle first, and loose film 75 is encouraged to collect in one of the reliefs 50, as shown in FIG. 4. The traces 36 which extend completely along the opposite side of the core resist buckling sufficiently to cause separation of the film from the upper end portion 42. Although the amount of loose film at the upper end portion is reduced, there is still a sufficient amount of loose film 76 to cause pinching and possible shorting.

With reference again to FIG. 3, according to the invention the elastomeric connector 30 has a crease 40 in the flexible film 34 which is directed into the adjacent relief 50. The crease 40 is formed by a tool which indents the flexible film sufficiently to produce a permanent deformation of the circuit traces 36. The crease is preferably directed perpendicular to the elongation axis of the connector.

Figure 5:
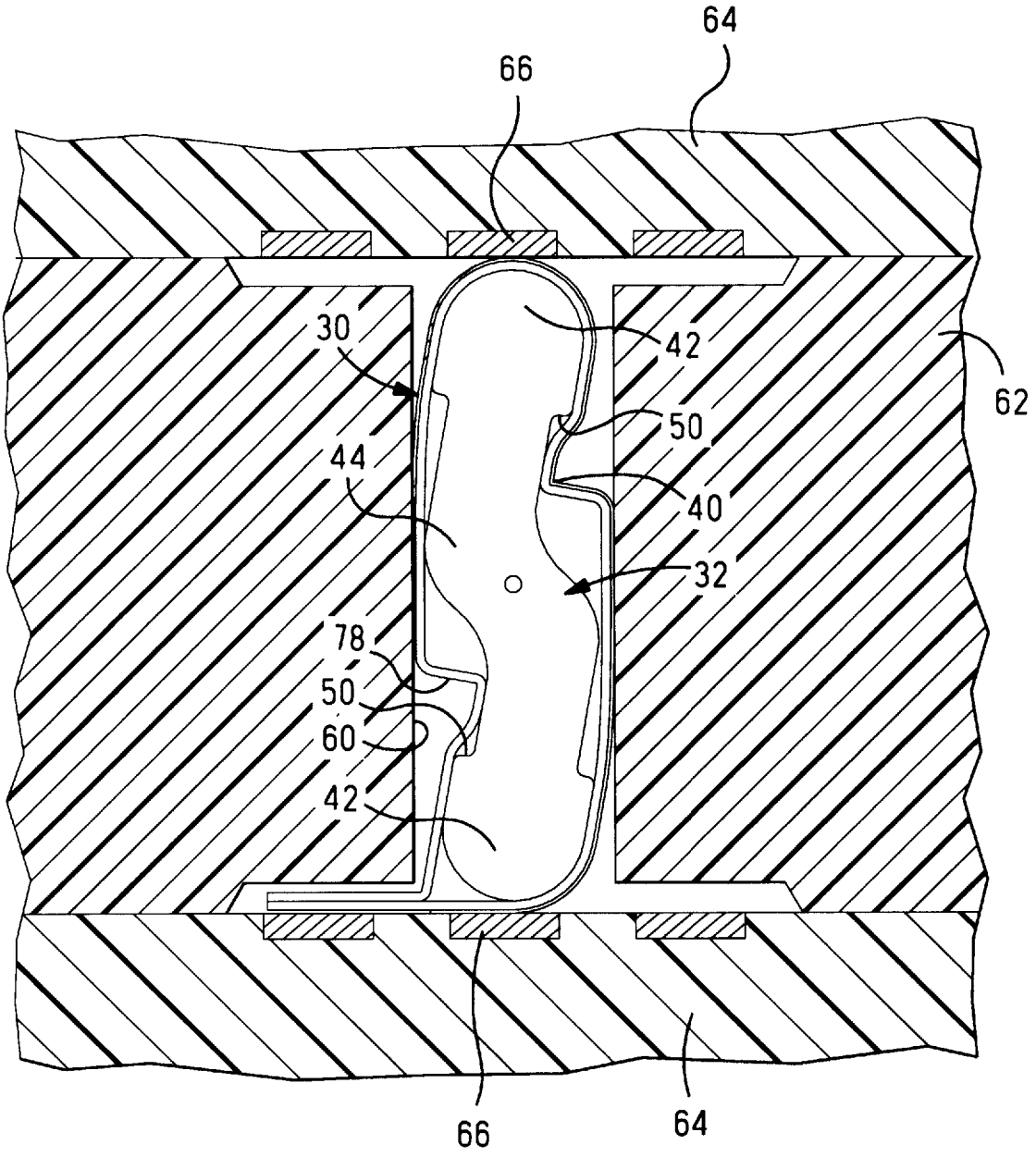
FIG. 5 is a cross-sectional view of a connector having reliefs and a crease according to the invention and being compressed within a slot in a housing.

As shown in FIG. 5, the crease 40 creates a natural buckling point which predisposes the film in the vicinity of the crease to gather in the adjacent relief 50 in the core when the connector is compressed. A loose portion 78 of the flexible film may gather in the corresponding relief 50 on the opposite side of the core. The crease 40 effectively eliminates separation of the film from the end portions 42, thereby preventing pinching of the circuit traces 36 and shorting between contact pads.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An elastomeric electrical connector comprising:

an elastomeric core having sides extending in a longitudinal direction between opposite ends, and a flexible film having circuit traces thereon wrapped around the core, one of the sides having a relief and the flexible film having a crease directed into the relief, wherein a portion of the flexible film in a vicinity of the crease is predisposed to gather in the relief when the core is compressed in the longitudinal direction.

2. The elastomeric electrical connector of claim 1 wherein the crease is directed perpendicular to the longitudinal direction.

3. The elastomeric electrical connector of claim 1 wherein the core is elongated in the longitudinal direction.

4. An elastomeric electrical connector comprising:

an elastomeric core having an elongation axis extending through opposite end portions of the core and a relief in a surface of the core intermediate the end portions, a flexible film having circuit traces thereon wrapped around the core and extending across the relief, the flexible film having a crease directed into the relief, wherein a portion of the flexible film in a vicinity of the crease is predisposed to gather in the relief when the core is compressed along the elongation axis.

5. The elastomeric electrical connector of claim 4 wherein the crease is directed perpendicular to the elongation axis.

6. An elastomeric electrical connector comprising:

an elastomeric core having an elongation axis extending through opposite end portions of the core, the end portions having sides which can be projected to define a core envelope, the core having a reduced thickness portion intermediate the end portions, the reduced thickness portion having a surface which is recessed below the core envelope, a flexible film having circuit traces thereon wrapped around the core coincident with the core envelope, the flexible film having a crease directed toward the recessed surface, wherein a portion of the flexible film in a vicinity of the crease is predisposed to gather in the recessed surface when the core is compressed along the elongation axis.

7. The elastomeric electrical connector of claim 6 wherein the crease is directed perpendicular to the elongation axis.

* * * * *